United States Patent [19]

Anderson

[11] Patent Number: 4,869,343

[45] Date of Patent: Sep. 26, 1989

[54] RAILING ASSEMBLY FOR SCAFFOLD

[76] Inventor: Carl Anderson, c/o Alum-A-Pole Corporation 2589 Richmond Terrace, Staten Island, N.Y. 10303

[21] Appl. No.: 215,255

[22] Filed: Jul. 5, 1988

[51] Int. Cl.[4] ..... E04G 1/26

[52] U.S. Cl. ..... 182/113; 182/141

[58] Field of Search ..... 182/113, 178, 179, 138, 182/137, 141

[56] References Cited

U.S. PATENT DOCUMENTS

| | | | |
|---|---|---|---|
| 2,706,662 | 4/1955 | Brown | 182/113 |
| 3,382,949 | 5/1968 | Bloch | 182/113 |
| 3,425,509 | 2/1969 | Gilbert | 182/113 |
| 3,853,203 | 12/1974 | Werner | 182/113 |
| 3,863,899 | 2/1975 | Werner | 182/113 |
| 4,129,197 | 12/1978 | Preston | 182/138 |
| 4,620,612 | 11/1986 | Enoki | 182/113 |
| 4,805,735 | 2/1989 | Anderson | 182/138 |

FOREIGN PATENT DOCUMENTS

| | | | |
|---|---|---|---|
| 2069581 | 8/1981 | United Kingdom | 182/113 |

*Primary Examiner*—Reinaldo P. Machado
*Attorney, Agent, or Firm*—Helfgott & Karas

[57] ABSTRACT

A safety railing assembly for a platform comprises a plurality of railing modules each having two upright post portions and at least one horizontal hand rail portion interconnected between the post portions. A plurality of mounting means are provided for supporting the modules along the periphery of the platform, the mounting means for each module comprising at least first and second clamps adapted to be slideably positioned along the fastened to the platform. The clamps have post receiving apertures shaped to receive and retain the posts in upright orientation. A substantially planar safety panel is coupled to the post and hand rail portions of each module for substantially enclosing a planar area defined by the post and hand rail portions and the platform. Fixed or rotatable end gate safety railing modules may also be provided.

23 Claims, 3 Drawing Sheets

RAILING ASSEMBLY FOR SCAFFOLD

RELATIONSHIP TO THE OTHER APPLICATIONS AND PATENTS

This invention relates to the following issued patents and pending U.S. patent applications, all by the inventor of the present application: U.S. Pat. No. 4,382,488 issued May 10, 1983 for PUMP JACK POLES; U.S. Pat. No. 4,432,435 issued Feb. 21, 1984 for CLAMPING DEVICE; U.S. Pat. No. 4,446,945 issued May 8, 1984 for BRACE FOR SECURING A POLE TO A SUPPORT SURFACE; U.S. Pat. No. 4,463,828 issued Aug. 7, 1984 for PUMP JACK; U.S. Pat. No. 4,499,967 issued Feb. 19, 1985 for SCAFFOLDING STAGING; U.S. Pat. No. 4,598,784 issued July 8, 1986 for SCAFFOLDING SYSTEM; U.S. Pat. No. 4,624,342 issued Nov. 25, 1986 for SCAFFOLDING PLATFORM; U.S. patent application Ser. No. 160,656 filed Feb. 26, 1988 for SCAFFOLDING NET SYSTEM; and U.S. patent application (9056), filed concurrently herewith for RAILING SUPPORT CLAMP FOR SCAFFOLD.

BACKGROUND OF THE INVENTION

This invention relates to scaffolding equipment and, in particular, to assemblies of safety railings, associated panels and/or nets for scaffold platforms.

In my U.S. Pat. No. 4,624,342 and in my copending patent application Ser. No. 160,656 referred to above, certain types of safety arrangements are described for use where scaffold platforms are provided at two or more levels on a given set of vertical supports, typically pump jacks.

Other arrangements are also known for mounting safety nets along the edge of scaffold platforms. Typically, such prior arrangements required that pre-drilled holes be provided in scaffold platform side rails and that safety railing support sleeves be bolted to such side rails in a tedious and time consuming manner. A primary concern in all such configurations, as well as in the case of the present invention is to provide devices to improve the safety of workers and equipment while they are aloft on scaffold platforms.

In the case of the present invention, it is a particular objective to provide adequately stable and sturdy supports for guard rails, panels and/or personnel retaining devices along the edges of scaffold platforms.

It is also an objective to provide such supports which are easily installed on a variety of different sized scaffold support beams.

It is a still further objective to provide such supports which readily may be positioned at desired locations along scaffold support beams.

It is a still further objective to provide a modular railing support system which may utilize modules interconnected in various combinations.

SUMMARY OF THE INVENTION

In accordance with one aspect of the present invention, an assembly for a safety rail or similar device which is adapted for mounting on a platform having peripheral side rails comprises a railing module having two upright post portions and at least one horizontal hand rail portion interconnected between the post portions. A plurality of mounting means are provided for supporting the module along the periphery of the platform, the mounting means comprising at least first and second adjustable clamps adapted for being slideably positioned along and fastened to one of the side rails. Each of the clamps has horizontal flanges engaging an associated side rail and extending outwardly from the periphery of the platform, the flanges having post receiving apertures spaced outwardly from the side rail and shaped to receive and retain the posts in upright orientation. The mounting means further comprises adjustable means for fastening and mounting means in position along the side rail.

In accordance with a further aspect of the invention, a safety railing assembly for a platform comprises a railing module having two upright post portions and at least one horizontal hand rail portion interconnected between the post portions. A plurality of mounting means are provided for supporting the module along the periphery of the platform, the mounting means comprising at least first and second clamps adapted to be slideably positioned along and fastened to the platform. The clamps have post receiving apertures shaped to receive and retain the posts in upright orientation. A substantially planar safety panel is coupled to the post and hand rail portions for substantially enclosing a planar area defined by the post and hand rail portions and the platform.

In accordance with yet another aspect of the invention, a common safety netting is provided, which covers the external sides of a plurality of adjacent railing modules and extending between the hand rail portions of the modules and the platform.

DESCRIPTION OF THE PREFERRED EMBODIMENT

Figure 1:
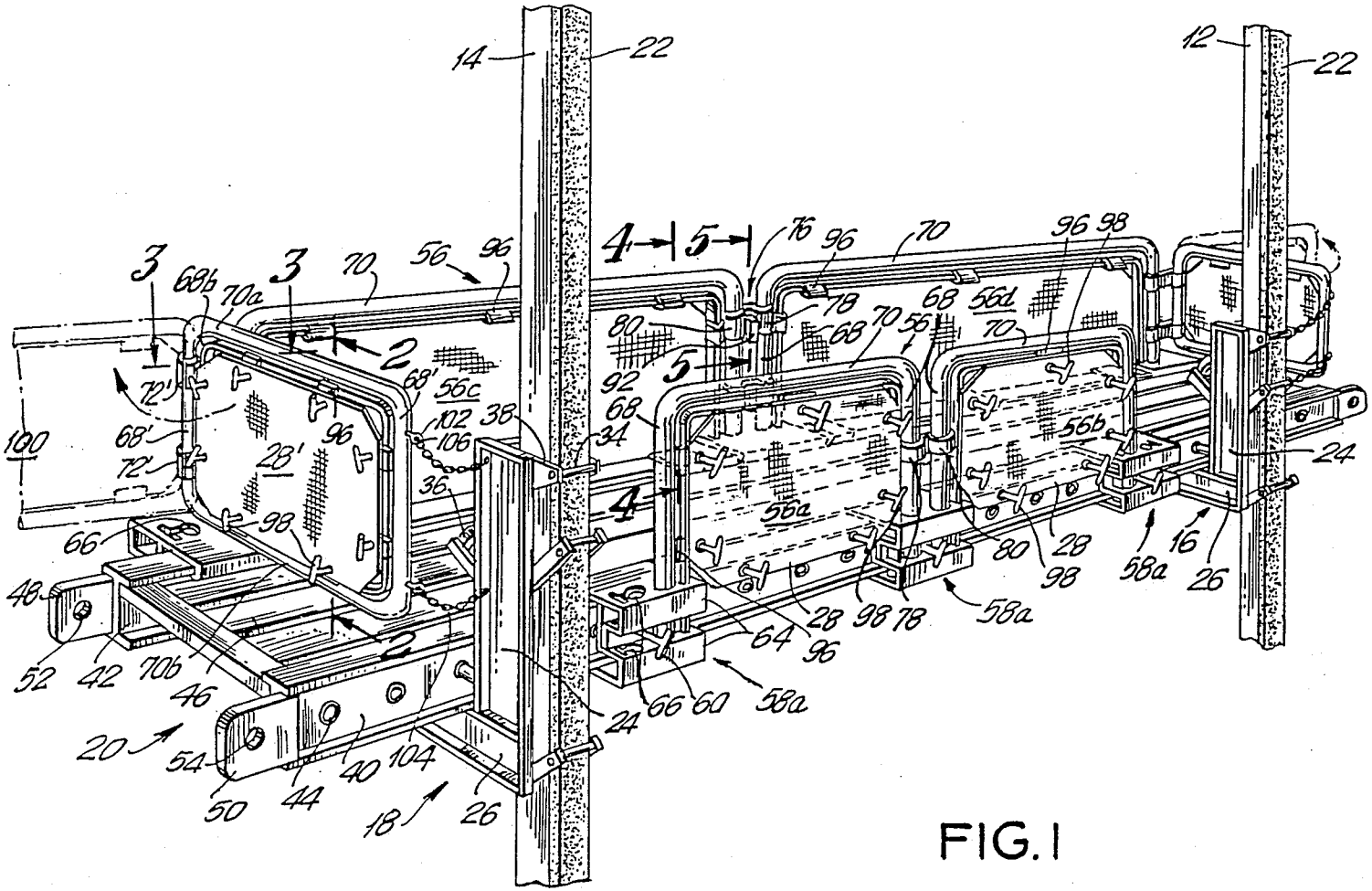
FIG. 1 is a perspective view of a scaffolding arrangement showing the use of a guard rail system in accordance with the present invention.

Referring now to FIG. 1, a scaffolding system 10 is shown, having a pair of spaced apart pump jack poles 12, 14 on which respective pump jacks 16, 18 ride. The pump jack poles 12, 14 which are shown are described in my U.S. Pat. No. 4,382,488. More specifically, each of poles 24 and 14 is a substantially rectangular hollow metal pole, on one side of which a rubberized surface zz is disposed. Such pump jack poles have been found to be stronger, longer-lasting, easier to use and more efficient than wooden poles.

The pump jacks 16, 18 may be of a type described in my U.S. Pat. No. 4,463,828. More specifically, each of the pump jacks 16, 18 comprises an upright frame portion 24 to which a platform support arm 26 is attached. The pump jacks (e.g., 18) include a lower shackle portion 30 and an upper shackle portion 32, each of which surrounds the pump jack pole 12. An upper roller portion 34 also surrounds the pole 12. The pump jack 18 is stepped up the pump jack pole 14 by means of a pumping arm 36. An over-the-center spring-loaded handle 38 is operated to roll the pump jack 18 down the pole 14.

A staging section or scaffold platform, indicated generally as 20, which rests on platform support arm 26 is formed of a pair of opposing I-beam side rails 40, 42. The side rails 40, 42 are held together by a plurality of spaced apart, preferably hollow rungs 44 in a manner similar to that employed in the construction of a ladder. A plurality of longitudinally extending decking slats or planks 46 overlie the rungs 44 to form the platform. At each end of the staging section, ears 48, 50 are provided which are fastened to the respective side rails 40, 42. Aligned apertures 52, 54 are provided in ears 48, 50 for coupling together adjacent staging sections as described in my U.S. Pat. No. 4,499,967.

All of the foregoing parts of the staging section typically are fabricated of a material such as aluminum or similar sturdy but lightweight materials.

It should be noted that the scaffold platform 20 normally is positioned with the rungs 44 near the top of the side rails 40, 42 whereby the rungs 44 are asymmetrically positioned relative to the end flanges of the I-shaped side rails 40, 42. In this manner, when the decking slats 46 are laid over rung 44, the tops of slats 46 and the top flanges of side rails 40, 42 provide a relatively flat work platform on which workers readily may stand. However, the staging section also may be inverted so that, when decking slats 46 are laid over the rungs 44, the decking slats 46 will be recessed relative to I-rails 40, 42. The resulting configuration may be used either as a platform to support workers or as a work bench whereon tools, equipment and the like may be placed while the workers stand on an adjoining platform as described in my co-pending application Ser. No. 160,656.

In accordance with the present invention, a plurality of safety railing modules indicated generally by the reference numeral 56 are provided along the edge of the staging section shown in FIG. 1.

Each of the safety railing modules 56 defines a planar space which is vertically oriented when the module 56 is mounted on side rail 40 and 42. Specifically, safety railing modules **56*a* and 56*b* are attached to I-beam side rail 40 in the space between pump jack poles 12 and 14. To that end, three sets of a first type of railing support clamp 58*a* are disposed along side rail 40. The illustrated railing support clamps 58*a*** are described in greater detail in my concurrently filed U.S. patent application Ser. No. (9056) entitled "RAILING SUPPORT CLAMP FOR SCAFFOLD".

Each of railing support clamps **58*a* overlaps and engages the top and bottom flanges of I-beam side rail 40 in the manner described in my concurrently filed application. Support clamps 58*a* are held in place by means of a threaded clamping screw 60 which passes through a threaded aperture in the web portion 62 of clamp 58*a* and bears against the central web portion of side rail 40**.

Before the clamping screw 60 is tightened, the clamps **58*a* are adjustable in a vertical direction so as to fit tightly over side rail 40 and are also adjustable in a horizontal direction to be positioned at an appropriate location along side rail 40 according to the length of the associated safety railing module 56*a*, 56*b*. As a result of the ease of installation and versatility of the clamps 58*a***, it is anticipated that the illustrated safety railing arrangement will be used in circumstances where more cumbersome and less versatile arrangements have been left off of scaffolds in the past.

The clamps **58*a* each include two U-shaped extensions 64 which are offset outwardly from side rail 40. The extensions 64 have two specially shaped apertures 66 for accepting and locking in position the individual upright post portions 68 of the safety railing modules 56*a*, 56*b*. Specifically, each of the apertures 66 in clamps 58*a* comprise an "O"-shaped portion for accepting a cylindrical part 68*a* of post portion 68 and an "I"-shaped or a "T"-shaped portion for accepting a T-shaped part 68*b* of post portion 68. The leg of the T-shaped portion is disposed perpendicular to the "O"-shaped portion in each of the apertures 66. The T-shaped part 68*b* of post 68 serves to lock the post 68 so that it will not twist in aperture 66, serves to strengthen the cylindrical part 68*a* and, furthermore, as will appear below serves as a retaining flange for an associated safety net or panel 28**.

Each of the railing modules **56*a*, 56*b* comprises two post portions 68 and at least one interconnecting rail portion 70 which together define a planar space. The cylindrical or O-shaped parts 68*a* of the post portions 68 and rail portion 70 extend around the outside of the planar space so that the rail portion 70 is a convenient and smooth cylindrical shape suitable as a hand rail without any abrupt or sharp edges. The T-shaped parts 68*b* of post portions 68 and rail portions 70 lie inwardly of the O-shaped parts 68*a* and provide particularly suitable structures for clamping of safety nets or the like over the enclosed planar area. The T-shaped parts 68*b* also impart additional rigidity to the posts 68 and rails 70**.

With the foregoing configuration in mind, it can readily be seen that the post receiving apertures 66 in railing support clamps **58*a* are disposed with their T-shaped portions adjacent the ends of extensions 64 and their O-shaped portions centrally disposed in extensions 64. The extensions 64, by virtue of their U-shape, provide a plurality of vertically displaced, lateral bearing zones (three in number) against the sides of upright post portion 68 to insure solid support for the safety railing modules 56*a*, 56*b*. These can be seen in FIG. 1, where the clamp 58*a*** has four horizontal flange sections. The T-O-shaped apertures extend through the top three flange surfaces providing the bearing support. The bottom flange is solid and the posts rest on these flanges.

It can also readily be seen that, in assembling a structure of the type shown in FIG. 1, the support clamps **58*a* may be placed in position along side rail 40 with the clamping screws 60 partially tightened. After one post of the safety railing module 56*a* is inserted into an aperture 66 in a first support clamp 56*a*; the second support clamp 58*a* may be moved along rail 40 into exact position to accept the second post of railing module 56*a*. Similarly, one post of second safety railing module 56*b* is inserted into the vacant aperture 66 of second support clamp 58*a* and then, after lateral adjustment of the third support clamp 58*a*, the second post of module 58*b* is inserted into the latter clamp. The clamping screws 60 of all three support clams 58*a* are then fastened tightly to retain the modules 56*a* and 56*b*** in position.

In accordance with a further aspect of the present invention, a cam-lock coupler or clamp 72 is provided between adjacent upright post portions 68 of modules **56*a*, 56*b* to provide further rigidity and to increase the strength of the safety railing arrangement with respect to horizontally applied forces. Cam-lock coupler 72 comprises two half clamps 74 and 76, each half-clamp having first and second generally semi-cylindrical half-sleeves 78, 80 interconnected by a web 82. The radius of curvature of half-sleeves 78, 80 is selected relative to that of the O-shaped part of post 68 so that half-sleeves 78, 80 fit snugly against the outside of posts 68, while leaving an opening to accommodate the T-shaped part of post 68**.

Figure 6:
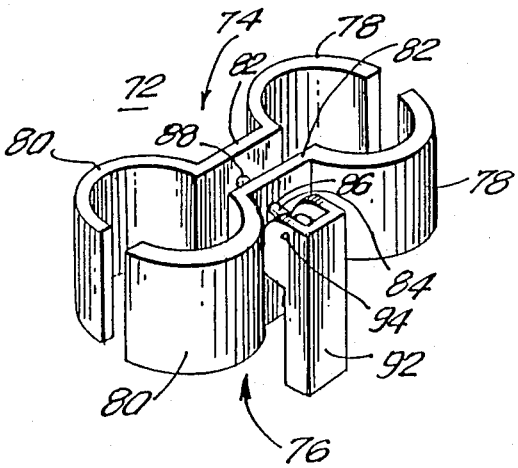
FIG. 6 is a perspective view of an interconnecting clamping arrangement.

The length of web 82 is selected substantially equal to the distance between the adjacent O-shaped portions of apertures 66 in support clamps 58*a*. A bolt 84 passes through aligned holes 86 and 88 in the two webs 82 of cam-lock coupler 72. A nut 90 at the innermost end of bolt 84 retains the bolt 84 within the holes 86, 88. A clamping lever 92 is fastened to an opposite enlarged end of bolt 84 by means of a pin 94. When clamping lever 92 is in its downward position (see FIG. 6), the half-clamps 74, 76 are pressed towards each other while, when clamping lever 92 is rotated around pin 94 so as to extend horizontally (relative to FIG. 6), the half-clamps 74, 76 are "opened". Thus, when the cam-lock couplers 72 are employed, prior to mounting of the second of the modules 65*a*, 56*b* into support clamps 58*a*, an open cam-lock coupler 72 is placed around the inner ones of posts 68 of each of the mounted and unmounted modules 56*a*, 56*b* and the second module (e.g., 56*b*) is mounted in its bracket 58*a*. The cam-lock coupler 72 is then positioned vertically along the adjacent post 68 and the clamping lever 92 is depressed to lock the coupler 72 onto posts 68.

Further details of a clamping lever of the type described above are also shown and described in my earlier-filed application Ser. No. 160,656.

As shown in FIG. 1, a safety netting 28 which can be of webbing or fabric or other panel material, is fastened to the T-shaped part 68*b* of each of modules 56*a*, 56*b* by means of modified "C"-clamps 96. The C-clamps 96 engage the end flange of the T-shaped part 68*b*. Each C-clamp 96 includes a threaded fastening screw 98 which passes through a hole along the edge of panels 28 and engages the web portion of the T-shaped part 68*b*. Further details of such a clamping arrangement are also shown and described in my prior application Ser. No. 160,656.

The panels 28 associated with modules 56*a*, 56*b* preferably extend downwardly a sufficient distance so that the C-clamps 96 along the lower edge of panels 28 may be fastened to either the upper or lower flange of I-beam side rail 40, as shown. In this manner, the panels 28 serve to retain any tools which may fall to the platform and also serve to prevent a worker from placing his foot beyond the edge of side rail 40.

The cam-lock coupler 72 may be employed in a second advantageous manner as is shown in connection with the mounting of an end gate 100. As may be seen at each end of platform 20, an end gate 100 comprises two vertical post portions 68' and upper and lower interconnecting rail portions 70*a* and 70*b*, respectively. The aforementioned post and rail portions 68, 70*a* and 70*b* define an enclosed rectangular planar area above and generally perpendicular to the decking 46. A safety panel 28' is attached to the T-shaped part 68*b'* of the post and rail portions 68', 70*a*, 70*b* in the manner described above with respect to railing modules 56*a*, 56*b* (note that the lower edge of safety panel 28' is attached to lower rail portion 70*b* in the case of the end gate 100).

Figure 2:
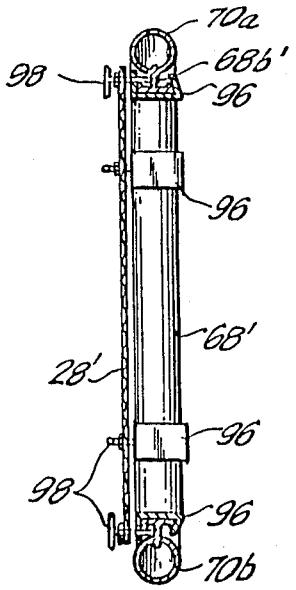
FIG. 2 is a cross-sectional view taken along the lines 2—2 in the direction of the arrows shown in FIG. 1.
Figure 4:
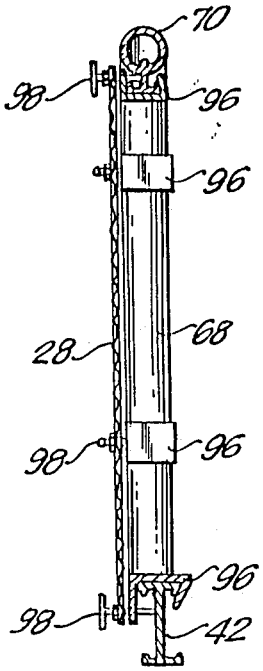
FIG. 4 is a cross-sectional view taken along the lines 4—4 in the direction of the arrows in FIG. 1.

In a modified embodiment, a common safety netting made of webbing or fabric or any other suitable material extends over the vertical outer areas of all safety railing modules 56. The common safety netting is fastened at the upper edge thereof to each of modules 56 by means of clamps 96 and bolts 98 in the same fashion as shown for individual panels or nets in FIGS. 1, 2 and 4. Two ends of the common netting are connected by clamps 96 and bolts 98 to the T-shaped parts 68*b*, of the post portions 68' of the end modules 56*a* and 56*c* to form a common safety screen for operators standing on the scaffold platform.

Figure 3:
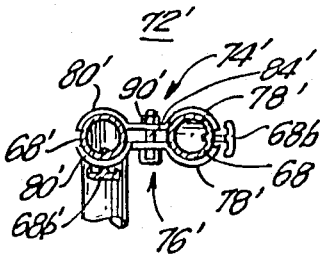
FIG. 3 is a cross-sectional view taken along the lines 3—3 in the direction of the arrows in FIG. 1.
Figure 5:
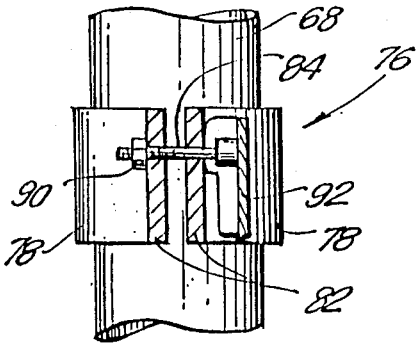
FIG. 5 is a cross-sectional view taken along the lines 5—5 in the direction of the arrows in FIG. 1.

Screw eyes 102 are provided in one of the post portions 68' (the "free" post portion 68') of end gate 100. Safety chains 104 are fastened to the adjacent fixed structure such as the upright frame portion 24 of pump jack 18 and include snap hooks 106 for attachment to eyes 102. The other post portion 68' (rearmost post portion in FIG. 1), is attached to the adjacent post portion 68 of a fixed railing module 56*c* by means of two cam-lock couplers 72'. As may be seen best in the cross-sectional view of FIG. 3, the cam-lock couplers 72' associated with end gate 100 serve as hinges to permit end gate 100, when desired to be swung open to permit ingress and egress to platform 20. The nuts 90' associated with cam-lock couplers 72' are adjusted on their respective bolts 84' to permit rotation of the associated post 68' of end gate 100 within the half-clamps 74' and 76'. Since the end gate 100 is normally disposed perpendicular to the railing module 56*c* (see FIG. 3), the web of the T-shaped part 68*b'* along the inside of the hinged post 68' is provided with upper and lower slots to permit the half-sleeves 80' to encircle the post 68'.

Figure 7:
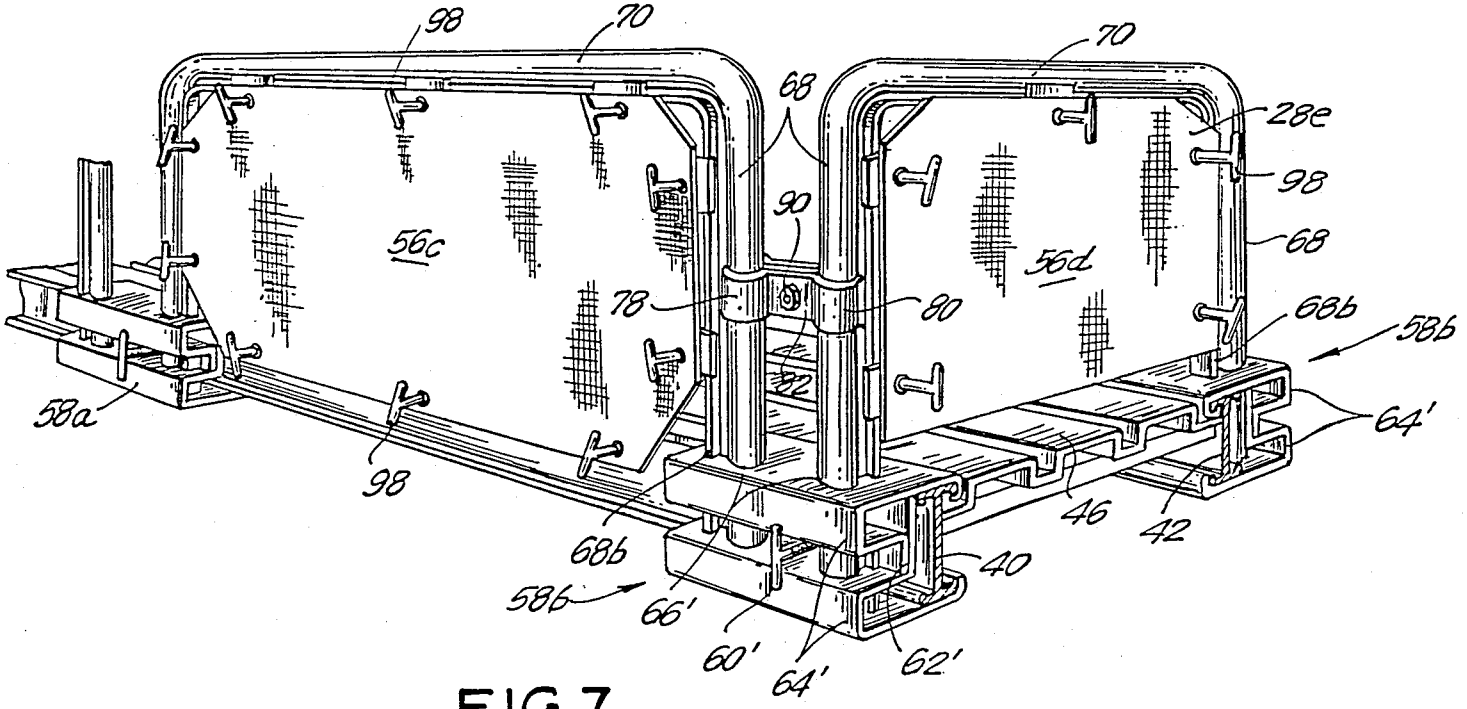
FIG. 7 is a perspective view of a stationary end rail module connected to a side rail module.

In certain circumstances, it will not be necessary or desirable to provide a movable end gate 100 on platform 20. Alternatively as is shown in FIG. 7, a fixed end safety railing module 56*d* may be provided at the end of platform 20. Safety railing module 56*d* is generally similar to modules 56*a*, 56*b* described above but is dimensioned according to the width of platform 20. Furthermore, since neither the side rails 40, 42 nor a lower railing (such as 70*b*) are available at the lower edge of end module 56*d*, the safety panel 28*e* associated with end module 56*d* is fastened only along upper rail 70 and upright posts 68 but is free along its lower edge.

Modified railing support clamps 58*b* are associated with end safety railing module 56*d* to take into account that the T-shaped part 68*b* of the posts 68 of end module 56*d* extend at a right angle relative to the similar part of the adjacent side safety railing module 56*c* (FIG. 7). Specifically, the apertures 66' in railing support clamps 58*b* are differently oriented, the T-shaped portions being at right angles to each other, with the T-shaped portion for the post 68 of end railing module 56*d* extending towards the web portion 68' of support clamp 58*b*.

The arrangements described above provide significant versatility while providing enhanced safety compared to prior systems. The use of the combined O-shaped and T-shaped (a modification of I-shaped) portions to form the elements of the safety rails provides both positive attachment for the safety nets to the T ("I") portions and good structural integrity for the rails and posts. The cylindrical portion of the horizontal rails provides the smooth hand grip to which workers are accustomed and also avoids dangerous sharp edges. Furthermore, the railing support clamps provide positive attachment of the posts to the main structure without being cumbersome or difficult to install.

It will be recognized that various materials and modifications as to shape may be employed without departing from the invention described above, the scope of which is set forth in the following claims.

What is claimed is:

1. A safety railing assembly for a platform comprising:

a railing module having two upright post portions and at least one horizontal hand rail portion interconnected between said post portions;

a plurality of mounting means for supporting said module along the periphery of said platform, said mounting means comprising at least first and second clamps adapted to be slideably positioned along and fastened to said platform, said clamps having post receiving apertures shaped to receive and retain said posts in upright orientation; and a substantially planar safety panel coupled to said post and hand rail portions for substantially enclosing a planar area defined by said post and hand rail portions and said platform.

2. A safety railing assembly according to claim 1 wherein:

a plurality of said railing modules are mounted adjacent to each other; and a second plurality of said clamps is provided greater in number by one than the number of said railing modules.

3. A safety railing assembly according to claim 2 wherein:

at least one of said clamps includes two of said apertures for receiving post portions from two adjacent ones of said modules.

4. A safety railing assembly according to claim 1 wherein:

said safety panel is further coupled to said platform along the lower edge of said panel.

5. A safety railing assembly according to any one of claims 1–4 wherein:

said post and hand rail portions each comprise an outer cylindrically shaped part and a T-shaped part joined thereto inwardly of said area, and said post receiving apertures are shaped to receive said joined shape.

6. A safety railing assembly according to any one of claims 2–4 wherein:

said mounting means further comprises a pair of interconnected half clamps coupled to post portions of adjacent ones of said modules adjacent said hand rail portions.

7. A safety railing assembly according to claim 6 wherein:

said half clamps each comprise two semi-cylindrical sleeves joined together by a web and an adjustable locking mechanism for causing said half clamps to be drawn together against respective post portions of said modules.

8. A safety railing assembly according to claim 6 wherein:

said post and hand rail portions each comprise an outer cylindrically shaped part and a T-shaped part joined thereto inwardly of said area, and said post receiving apertures are shaped to receive said joined shape.

9. A safety railing assembly according to claim 1 and further comprising:

an end gate module having two upright post portions and upper and lower rail portions interconnected between said post portions to define a closed planar area;

a substantially planar end gate safety panel coupled to said last-named post and rail portions; and said mounting means further comprising at least two pairs of interconnected half clamps coupled between one post portion of said railing module and one post portion of said end gate module to provide a hinged connection between said modules.

10. A safety railing assembly according to claim 9 wherein:

said half clamps each comprise two semi-cylindrical sleeves joined together by a web and an adjustable locking mechanism for causing said half clamps to be drawn together against respective post portions of said modules.

11. A safety railing assembly for a platform having peripheral side rails comprising:

a railing module having two upright post portions and at least one horizontal hand rail portion interconnected between said post portions;

a plurality of mounting means for supporting said module along the periphery of said platform, said mount said mounting means comprising at least first and second adjustable clamps adapted for being slideably positioned along and fastened to one of said side rails, each of said clamps having horizontal flanges engaging an associated side rail and extending outwardly from said side rail, shaped to receive and retain said posts in upright orientation, said mounting means further comprising adjustable means for fastening said mounting means in position along said side rail.

12. A safety railing assembly according to claim 1 wherein:

a plurality of said railing modules are mounted adjacent to each other; and a second plurality of said clamps is provided greater in number by one than the number of said railing modules.

13. A safety railing assembly according to claim 12 wherein:

at least one of said clamps includes two of said apertures for receiving post portions from two adjacent ones of said modules.

14. A safety railing assembly according to claim 11 wherein:

said safety panel is further coupled to said platform along the lower edge of said panel.

15. A safety railing assembly according to any one of claims 11–14 wherein:

said post and hand rail portions each comprise an outer cylindrically shaped part and a T-shaped part joined thereto inwardly of said area, and said post receiving apertures are shaped to receive said joined shape.

16. A safety railing assembly according to any one of claims 12–14 wherein:

said mounting means further comprises a pair of interconnected half clamps coupled to post portions of adjacent ones of said modules adjacent said hand rail portions.

17. A safety railing assembly according to claim 16 wherein:

said half clamps each comprise two semicylindrical sleeves joined together by a web and an adjustable locking mechanism for causing said half clamps to be drawn together against respective post portions of said modules.

18. A safety railing assembly according to claim 16 wherein:

said post and hand rail portions each comprise an outer cylindrically shaped part and a T-shaped part joined thereto inwardly of said area, and said post receiving apertures are shaped to receive said joined shape.

19. A safety railing assembly according to claim 11 and further comprising:

an end gate module having two upright post portions and upper and lower rail portions interconnected between said post portions to define a closed planar area;

a substantially planar and gate safety panel coupled to said last-name post and rail portions; and said mounting means further comprising at least two pairs of interconnected half clamps coupled between one post portion of said railing module and one post portion of said end gate module to provide a hinged connection between said modules.

20. A safety railing assembly according to claim 19 wherein:

said half clamps each comprise two semi sleeves joined together by a web and an adjustable locking mechanism for causing said half clamps to be drawn together against respective post portions of said modules.

21. A safety railing assembly for a platform comprising:

a plurality of railing modules mounted adjacent to each other and each having two upright post portions and at least one horizontal hand rail portion interconnected between said post portions;

a plurality of mounting means for supporting each module along the periphery of said platform, said mounting means comprising at least first and second clamps adapted to be slideably positioned along and fastened to said platform said clamps having post receiving apertures shaped to receive and retain said posts in upright orientation; and a substantially planar safety means coupled to said post and hand rail portions for substantially enclosing a planar area defined by said hand rail portions of said modules and said platform.

22. A safety railing assembly according to claim 21, wherein said planar safety means includes a safety netting.

23. A safety railing assembly according to claim 22, wherein said netting covers external sides of said modules.

* * * * *